US005642575A

United States Patent [19]

Norton et al.

[11] Patent Number: 5,642,575

[45] Date of Patent: Jul. 1, 1997

[54] MIDSOLE CONSTRUCTION

[76] Inventors: Edward J. Norton, 92 Middleton Rd., Boxford, Mass. 01921; Zenon O. Smotrycz, 51 Avalon Rd., Reading, Mass. 01867

[21] Appl. No.: 519,486

[22] Filed: Aug. 25, 1995

[51] Int. Cl.[6] ..... A43B 13/18

[52] U.S. Cl. ..... 36/27; 36/28; 36/30 R

[58] Field of Search ..... 36/27, 28, 3 B, 36/59 R, 8.1, 30 R

[56] References Cited

U.S. PATENT DOCUMENTS

| | | | |
|---|---|---|---|
| 886,801 | 5/1908 | Harmon | 36/28 |
| 1,852,238 | 4/1932 | Gilkerson | 36/28 X |
| 1,962,526 | 6/1934 | Riddell | 36/59 R |
| 4,063,371 | 12/1977 | Batra | 36/3 B |
| 4,342,158 | 8/1982 | McMahon et al. | 36/35 R |
| 4,380,878 | 4/1983 | Skaja | 36/67 |
| 4,399,620 | 8/1983 | Funck | 36/28 X |
| 4,774,774 | 10/1988 | Allen, Jr. | 36/28 |
| 4,815,221 | 3/1989 | Diaz | 36/27 |
| 4,878,300 | 11/1989 | Bogaty | 36/35 |
| 5,005,300 | 4/1991 | Diaz et al. | 36/114 |
| 5,014,449 | 5/1991 | Richard et al. | 36/114 |
| 5,067,255 | 11/1991 | Hutcheson | 36/43 |
| 5,185,943 | 2/1993 | Tong et al. | 36/27 X |
| 5,255,451 | 10/1993 | Tong et al. | 36/30 |
| 5,319,866 | 6/1994 | Foley et al. | 36/91 |
| 5,353,526 | 10/1994 | Foley et al. | 36/92 |
| 5,367,792 | 11/1994 | Richard et al. | 36/114 |

FOREIGN PATENT DOCUMENTS

| | | |
|---|---|---|
| 0584489 | 2/1925 | France . |
| 9204944 | 4/1992 | WIPO . |

*Primary Examiner*—Ted Kavanaugh
*Attorney, Agent, or Firm*—Lahive & Cockfield

[57] ABSTRACT

A composite midsole for shoes comprising an energy absorbing cellular foam cushion having recesses extending inwardly from its undersurface, thermally bonded to a sheet of resilient material extending over the undersurface and into the recesses to form domes of the resilient material. Impact energy is partially absorbed by compression of the cushion and partially transmitted to cause spring-like deflection of the domes. The combined effect is selectively variable over the area of the midsole to produce the desired cushioning properties in localized areas of the midsole.

5 Claims, 2 Drawing Sheets

FIG. 1
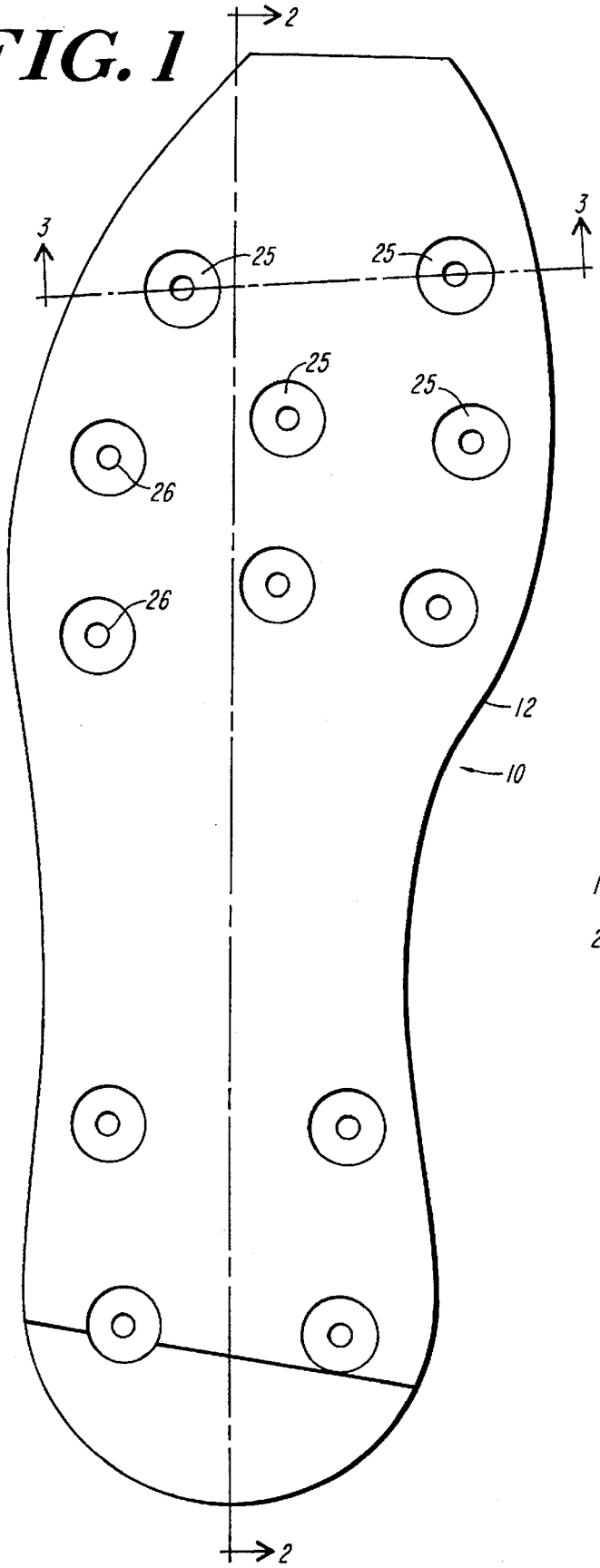
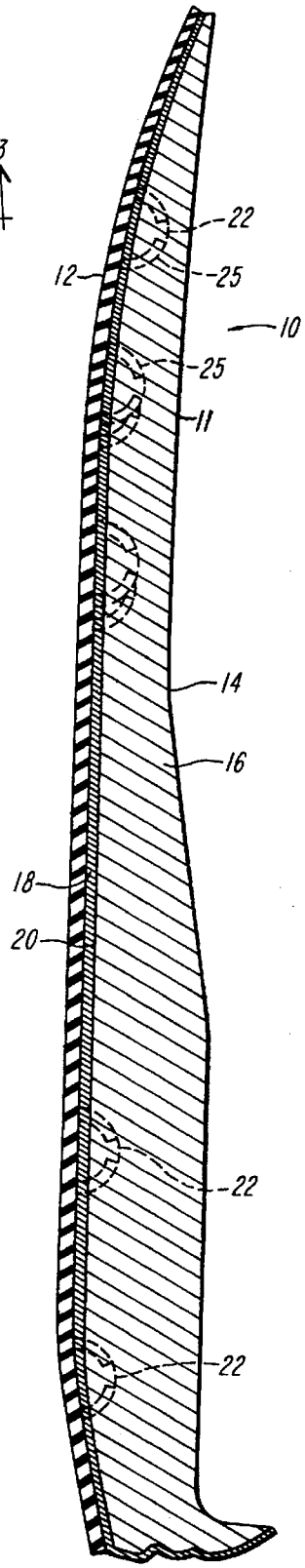
FIG. 2

MIDSOLE CONSTRUCTION

BRIEF SUMMARY OF THE INVENTION

This invention relates generally to midsole construction for shoes, and more particularly to midsoles suitable for high impact use, as in athletic shoes.

Midsoles commonly include a layer or cushion of compressible energy absorbing material having sufficient resiliency to return to the original shape after compression. Materials presently in preferred use for this purpose are polyurethane (PU) and ethyl vinyl acetate (EVA) in foamed cellular form. While these materials have certain advantages in terms of shock attenuation, flexibility and light weight, there are also disadvantages, in particular their mechanical instability, progressive breakdown in use and consequent lack of durability.

Such materials are also limited in their ability to accommodate the differing cushioning requirements for a midsole over particular areas of the foot surface, such as the metatarsal heads, the toe area and the heel area. Consequently, components of other materials are generally added to the PU or EVA cushion material to provide better localized shock absorbing properties. The addition of these materials may add to the weight of the sole unit and may detract from the flexibility of the composite midsole. However, such added materials often provide no appreciable improvement in the durability of the cellular foam component.

An object of this invention is to enhance the overall shock attenuation characteristics of a foamed midsole in each localized area thereof according to the distribution of shock impact over the gait cycle from heel strike to toe off.

A second object is to reduce the overall weight of the combined midsole and outsole while achieving these desired enhanced shock attenuation characteristics.

Another object is to provide a stabilizing structure for the cellular foamed cushion material, thereby significantly increasing its durability.

A further object is to provide midsole structures that can be manufactured at low cost, with capability of adaptation to a wide range of footwear products having differing functional requirements in terms of shock attenuation through the gait cycle.

With the foregoing objects and other objects hereinafter appearing in view, the features of this invention include a novel composite midsole comprising an energy absorbing cellular foam cushion bonded to a sheet of resilient material extending over the undersurface of the cushion. The cushion is formed with dome-like recesses extending inwardly thereof. The sheet extends over the undersurface of the cushion and into the recesses, forming domes. The domes have mechanical spring like action in each recess, deflecting under forces transmitted through the cellular foam cushion, temporarily storing energy and rebounding after the impact force is removed. The net cushioning effect is the combined result of compression of the cushion material and deflection of the domes of resilient material.

The novel midsole is inexpensively formed by placing a preformed body of the energy absorbing cellular foam material together with a flat sheet of the resilient material in a heated mold having a time and temperature control.

The invention makes possible numerous variations in the structure of the composite midsole. The number, configurations and distribution of the dome-like recesses may be varied over the area of the undersurface. The characteristics of the cellular foam cushion and the resilient sheet, including the material compositions, hardness, durometer and thickness, may be varied. Also, the extent of coverage of the walls of the recesses by the domes may be varied. By these and other means, a substantial range of net shock attenuation characteristics can be imparted to the composite midsole to adapt it for particular shoe types and uses.

DESCRIPTION OF THE DRAWING

FIG. 1 is a bottom view of a combined outsole and midsole unit embodying one form of the invention.

FIG. 2 is an elevation in section on line 2—2 of FIG. 1.

DETAILED DESCRIPTION

Figure 3:
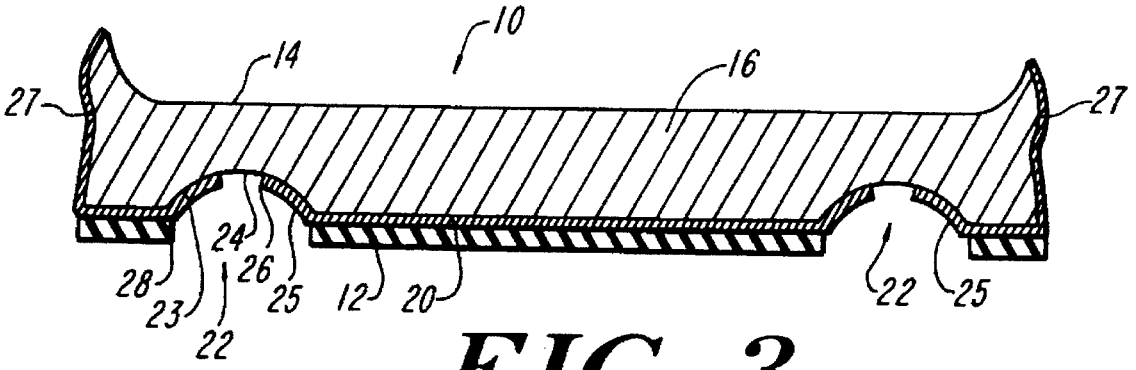
FIG. 3 is an elevation in section on line 3—3 of FIG. 1.

FIGS. 1 to 3 illustrate a sole unit 10 comprising a composite midsole 11 according to this invention and an outsole 12 of rubber or other material secured to the midsole in a conventional manner, as by adhesive with or without the application of heat. The composite midsole has an upper portion 14 formed for lasting to an upper and insole in a conventional manner. The upper and insole, being of conventional construction, are omitted from the drawing.

The midsole 11 comprises a cushion 16 of thermoplastic cellular foam EVA or other suitable energy absorbing foam material and a sheet 18 of resilient material of a type which tends to return to its original shape in a spring-like manner after deformation, as hereinafter described. One suitable material for the sheet 18 is sold by Dupont under the trademark Hytrel, which is a lightweight, stable, non-fatigue polyester elastomer of high tear strength and exceptional resiliency, rebound and memory characteristics. Hytrel is a semi-crystalline, fully polymerized, high molecular weight elastomer composed of alternate amorphous and crystalline chains. Hytrel is sold in a number of suitable formulations and hardness characteristics, for example No. 4056 and No. 4074 of Shore D durometer hardness 40, and No. 8236 of Shore D durometer hardness 82. Preferably, the thickness of the sheet 18 is 1 to 3 mm. In a typical embodiment the thickness of the sheet 18 on the undersurface 20 is 2 mm, and in some cases it may be greater or less if required to produce the desired "spring rate" or flexural stiffness in the domes. The sheet 18 is intimately mechanically bonded to an undersurface 20 of the cushion 16 as hereinafter described.

The cushion 16 has a plurality of heat formed hollow, dome-like recesses 22 extending inwardly from the undersurface 20. The locations of the recesses on the midsole are predetermined by the net shock attenuation characteristics to be imparted to the respective local areas of the midsole. Referring to FIG. 3, each recess has a wall 23 sloping inwardly to a ceiling 24. The sheet 18 extends over the undersurface 20, around the periphery of each recess 22, and into each recess in bonded contact with a portion of its wall 23, forming a dome 25. In the embodiment of FIGS. 1 to 3 each dome 25 is formed with a circular aperture 26 exposing the innermost or ceiling portion 24 of the wall of the recess 22, exposing the EVA body at such aperture. The sheet 18 is continuous from the undersurface 20 into the dome 25 at and around the entire base of the dome 25. The size of the aperture 26 is determined by its effect on the spring-like action required at the location of the dome, as will be better understood from the following description. In the illustrated embodiment the recesses are hemispherical in shape, although other inwardly sloping configurations may be used.

Fabrication of the midsole 11 is preferably accomplished in a heated mold. One of the mold parts is shaped to form the desired upper portion 14 for attachment to the shoe upper, a second mold part forming the sheet 18, the recesses 22 and the domes 25. A preformed body of EVA is inserted into the open mold and a sheet of Hytrel is placed on top of the preformed body. The mold is closed and heated to a temperature at which mechanical bonding and thermal forming of the EVA body and Hytrel sheet occurs, this temperature being sustained for a sufficient time to complete the thermal forming and mechanical bonding of the two elements.

As will be further evident from FIG. 3, the sheet 18, when formed as described above, reinforces the body 16 of relatively soft EVA, thereby substantially increasing its stability. In the embodiment of FIGS. 1 to 3 the formed sheet 18 is wrapped over the side portions 27 of the cushion 16 and is heat bonded thereto to provide additional stability particularly in the heel and forefoot areas. In other embodiments the sheet 18 may extend over only the undersurface 20 and not over the side portions 27, or over only a selected length or portion of the undersurface 20.

The integrally molded composite midsole 11 is subsequently attached to the outsole 12 which has been preformed to provide apertures 28 at and around the base of each of the recesses 22. The structure shown provides the advantage that these apertures and other portions of the outsole can be eliminated from nonwear areas, thus reducing the overall weight of the sole unit 10. In the embodiment shown the outsole is of uniform thickness for purposes of illustration, but in other embodiments it may be sculpted to provide treads or other features and advantages that are conventional and well understood in the art.

In use, the midsole 11 comprising the integrally bonded EVA cushion 16 and Hytrel sheet 18 provides a net localized cushioning effect over each of the recesses 22 that results from the combined action of the two components. A shock force compresses the EVA over the recess, whereby the cushion 16 absorbs a portion of the energy. A portion of the shock force is transmitted by the EVA cushion to the domes 25 lining the recesses 22, deflecting the domes in a manner similar to the action of Belleville springs. The domes store additional shock energy to provide mechanical cushioning action with resiliency.

It will be readily recognized that the above-described combined shock absorbing action can be varied in a number of ways. These include variations in the location, number, depth, size and shape of the recesses 22, the thickness of the sheet 18, the compressive properties of the EVA, and the thickness and hardness characteristics of the sheet 18. In most cases there is preferably an appreciable thickness of foam cushion material over the dome-like recesses.

Figure 4:
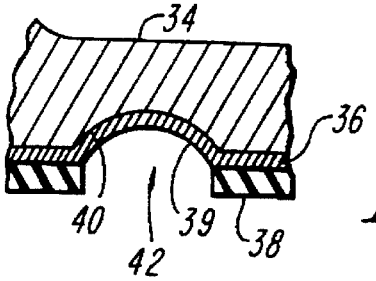
FIG. 4 is a fragmentary elevation showing a second embodiment.

FIG. 4 illustrates a second embodiment of the invention comprising a cushion 34 such as EVA, a sheet 36 such as Hytrel and an outsole 38. The embodiment of FIG. 4 differs from that of FIG. 3 in that the sheet 36 forms a dome 39 extending continuously over the entire wall 40 of the recess 42 formed in the cushion 34. This embodiment produces increased mechanical spring-like action of the dome 39.

Figure 5:
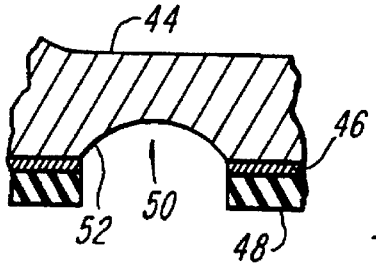
FIG. 5 is a fragmentary elevation showing a third embodiment.

FIG. 5 illustrates a third embodiment comprising a cushion 44, a sheet 46 and an outsole 48. In this embodiment the recess 50 is not provided with a dome, and the shock absorbing properties at such a recess are those imparted exclusively by the cushion 44, modified by the formed recess 52.

In the embodiment of FIG. 5 and in the embodiments of FIGS. 3 and 4, the outsole may extend into the recess 22, 42 or 50, lining the wall of the recess. In certain areas of the undersurface 20 such as non-loadbearing areas the recesses may be unlined by the flexible sheet as in FIG. 5, and in other areas of the undersurface the recesses may have domes as in FIG. 3 and/or FIG. 4.

As described above, the thermally formed midsole 11 may contain any chosen number of recesses and domes. In some footwear products there are preferably from ten to fifteen in number, and the recesses and domes may be of the same or of differing sizes and complexity of configuration. A given dome may have either an open ceiling, a partially closed ceiling, or a fully closed ceiling, the mechanical resilient action of the plastic domes being greater for greater coverage of the wall of the recess in the foam cushion material. The dome deflection under shock varies from great to moderate to small, creating a corresponding soft to firm cushioned response, depending upon the thickness of foam cushion that is compressed and the thickness and hardness of the plastic dome.

By incorporating the plastic sheeting between the foam cushion and a solid rubber outsole as described, the action of the foam cushion material is moderated, dispersing shock more evenly over the area of the midsole.

The invention herein described provides the following five principal advantages. First, by means of the multiple spring-like domes thermally formed in the plastic sheet, the shock absorbing properties of the foam cushion are increased. Second, the stability of the foam cushion is increased by the reinforcing properties of the plastic sheet, thereby providing lightweight rigidity. Third, the weight of the sole unit may be reduced by eliminating portions of the outsole in nonwear areas, such areas being covered instead by the lightweight, stable plastic sheet material. Fourth, the foam cushion material and the resilient sheet may be molded into an integral body in one molding process, eliminating tooling cost and producing an integrated, multifunction, moderated, shock-attenuating midsole unit. Fifth, means are provided for increasing the cushioning and shock attenuation properties of the sole unit throughout the gait cycle by the introduction of mechanical cushioning in key load areas. In particular, the loading of shock forces at heel strike and at the metatarsal head area at toe off may be thus controlled.

We claim:

1. A sole structure for footwear comprising, in combination, a midsole having an energy absorbing, compressible cellular foam cushion having an undersurface extending over a predetermined foot area, a plurality of mutually spaced discrete recesses formed in the cushion, each recess having a closed periphery in said undersurface spaced inwardly from the outer extremities of said area and having a continuous wall extending from and sloping inwardly of said periphery to a ceiling, said cushion having a thickness extending over said ceiling, and a sheet comprising a layer of resilient material which tends to return to its original shape after shock deformation, said sheet being bonded to said undersurface over said area and forming an integral dome extending into each recess, each dome extending continuously from said undersurface around the entire periphery of the recess and in bonded contact with the wall thereof, and an outsole extending over said area and secured to said undersurface, the outsole having an aperture at and around the periphery of each recess, the outsole being formed and adapted to transmit shock forces into said cushion around the periphery of said recesses, whereby said forces deflect the domes with a spring-like action.

2. A sole structure according to claim 1, in which the dome extends in bonded contact over the entire surface of said wall.

3. A sole structure according to claim 1, in which the dome extends in bonded contact over a portion of said wall excepting a predetermined area of said ceiling.

4. A sole structure according to claim 1, in which the cushion has a plurality of said recesses spatially distributed to achieve predetermined cushioning effects in corresponding localized areas of said undersurface.

5. A sole structure according to claim 1, in which said recesses are substantially hemispherical in shape.

* * * * *